United States Patent [19]

Murata

[11] Patent Number: 4,927,280

[45] Date of Patent: May 22, 1990

[54] PLATEN ROLLER

[75] Inventor: Jun Murata, Saitama, Japan

[73] Assignee: Canon Kabushiki Kaisha, Tokyo, Japan

[21] Appl. No.: 415,461

[22] Filed: Oct. 2, 1989

Related U.S. Application Data

[63] Continuation of Ser. No. 159,540, Feb. 22, 1988, abandoned.

[30] Foreign Application Priority Data

Feb. 23, 1987 [JP] Japan ..... 62-37734

[51] Int. Cl.[5] ..... B41J 11/02; B41B 31/08

[52] U.S. Cl. ..... 400/661; 29/129; 29/132

[58] Field of Search ..... 400/659, 661, 661.1, 400/662; 29/110, 129, 132

[56] References Cited

U.S. PATENT DOCUMENTS

| | | | |
|---|---|---|---|
| 1,133,697 | 3/1915 | Barney | 400/659 |
| 1,256,361 | 2/1918 | O'Keefe | 29/129 |
| 1,375,629 | 4/1921 | Colgin | 29/129 |
| 1,963,856 | 6/1934 | Lewis et al. | 400/661.1 |
| 2,053,107 | 9/1936 | Pitman | 400/661.1 |
| 2,742,999 | 4/1956 | Davidson | 29/129 |
| 3,389,448 | 6/1968 | Buysch | 29/110 |
| 4,583,272 | 4/1986 | Keller | 29/132 |

FOREIGN PATENT DOCUMENTS

| | | | |
|---|---|---|---|
| 249419 | 12/1987 | European Pat. Off. | 400/661.1 |
| 0162672 | 8/1985 | Japan | 400/662 |
| 280960 | 12/1986 | Japan | 400/661.1 |

*Primary Examiner*—Eugene H. Eickholt

*Attorney, Agent, or Firm*—Fitzpatrick, Cella, Harper & Scinto

[57] ABSTRACT

A platen roller comprises a solid cylindrical base body which has rotating shafts secured to both ends thereof and a hard elastic layer which is applied to the outer circumference of the solid cylindrical base body. The ratio of diameter of the solid cylindrical base body to the outside diameter of the finished platen roller including the solid cylindrical base body and the hard elastic layer is arranged to be within a range from 45 to 75%.

11 Claims, 2 Drawing Sheets

PLATEN ROLLER

This application is a continuation of application Ser. No. 159,540 filed Feb. 22, 1988, now abandoned.

BACKGROUND OF THE INVENTION

1. Field of the Invention

This invention relates to a platen roller and more particularly to a platen roller used for a printer of a typewriter of the so-called daisy-wheel (DW, for short) impact type or the like.

2. Description of the Related Art

The platen roller which has been used for the printer of a typewriter or the like is provided with rotating shafts at both ends thereof and is generally composed of a metal cylinder made of stainless steel, aluminum or a soft steel material or the like with a hard rubber coating applied to the surface of the metal cylinder. However, in cases where the printer is of the kind called a print hammer type printer, the conventional platen roller has produced a great noise and vibrations in printing. To mitigate it, platen rollers having their cylinders filled with some noise and vibration-preventing materials such as a foamed plastic or thermoplastic resin material have been developed in recent years.

However, these platen rollers of the prior art are still incapable of sufficiently preventing the noises and vibrations.

SUMMARY OF THE INVENTION

This invention aims to solve the above stated problems of the platen rollers of the prior art.

It is, therefore, an object of this invention to provide a platen roller which is capable of preventing noises and vibrations from being produced by a hammer impact during printing.

The above and other objects and features of the invention will become apparent from the following detailed description of embodiments thereof taken in connection with the accompanying drawings.

CONSTRUCTION OF THE INVENTION

Figure 1:
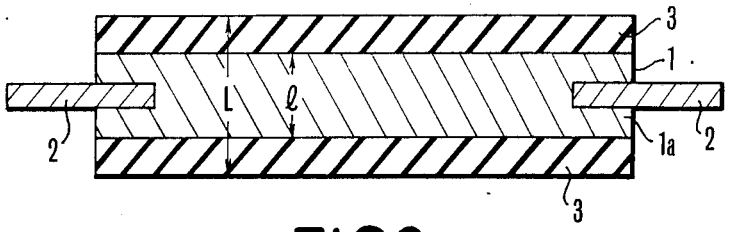
FIGS. 1 to 4 are sectional view respectively showing platen rollers arranged according to this invention as embodiments thereof.

In accordance with this invention, a platen roller is composed of a solid cylindrical base body which has rotating shafts at both ends thereof and a hard elastic layer applied round the outer circumference of the solid cylindrical base body. The ratio of the diameter of the solid cylindrical base body to the outside diameter of the finished platen roller including the solid cylindrical base body and the hard elastic layer is arranged to be between 45 and 75%.

The platen roller according to this invention absorbs the vibrations generated by the hammer impact during printing with the hard elastic layer provided on the outer circumference of the platen roller. The vibrations are further absorbed by the solid cylindrical base body which is made of a rigid vibration resisting material and is disposed on the inner side of the elastic layer. In addition to that, the diameter of the solid cylindrical base body and the outside diameter of the finished platen roller are arranged to be in such a ratio that is apposite to the absorption of the vibrations in question. More specifically, the platen roller essentially comprises the solid cylindrical base body which has its diameter arranged to be in the ratio between 45 and 75% to the outside diameter of the finished platen roller; and the hard elastic layer which is disposed round the outer circumference of the cylindrical base body.

The vibrations generated by the impact on the surface of the platen roller is absorbed first by the hard elastic layer with which the outer circumference of the solid cylindrical base body is coated. Then, the vibrations are further absorbed by the solid cylindrical base body which is made of the rigid vibration resisting material. Therefore, the platen roller permits adequate printing with noises and vibrations sufficiently suppressed. The excellent sound and vibration suppressing effects have been hardly attainable by the platen rollers of the prior art having a hollow cylindrical base body the diameter of which is in the range of ratio between 50 and 70% to the outside diameter of the finished product. However, if the ratio of the diameter of the base body is less than 45%, such a great sound and vibration preventing effect is hardly attainable. If, on the other hand, the ratio exceeds 75%, the platen roller becomes too heavy to cause an excessive load on a motor which is arranged to drive the roller. Therefore, such an excessive ratio is hardly practicable.

DETAILED DESCRIPTION OF THE PREFERRED EMBODIMENTS

A platen roller which is arranged according to this invention as a preferred embodiment thereof includes a solid cylindrical base body having rotating shaft parts at both ends thereof and a solid cylindrical base body part and a hard elastic layer. The rotating shaft parts are made of a material which excels both in corrosion resistance and in sliding movement characteristic, while the solid cylindrical base body part excels in vibration suppressing effect. The hard elastic layer is provided on the outer circumference of the solid cylindrical base body and is preferably made of a rubber material which also excels in vibration suppressing effect.

As mentioned above, the solid cylindrical base body includes the rotating shafts and the base body part which are arranged to be separate members, because: This arrangement is advantageous in terms of reduction in cost as compared with the use of a base body which is arranged in one body. In other words, the platen roller is to be rotatively used as a printing paper conveying means of the printer of a typewriter or the like. Therefore, the durability of the platen roller greatly depends on the material of the rotating shafts. If the solid cylindrical base body has its rotating shafts and its base body part formed in one body, its material must be selected in consideration of physical properties including the slidability and the corrosion resistance. This requirement severely limits the range of selectable materials and tends to increase the cost of the roller. On the contrary, where the rotating shafts are formed separately from the base body part and, for example, press-inserted into the base body part to produce the solid cylindrical base body, the rotating shafts are permitted to be made of a material which can be selected simply in consideration of slidability and corrosion resistance, and the base body part is permitted to be made of a material which can be selected simply in consideration of a vibration suppressing effect. This not only broadens the range of material selection but also is advantageous in terms of reduction in cost.

The details of this invention will be fully understood from the following description given with reference to the accompanying drawings:

FIG. 1 shows in a sectional view an example of platen rollers embodying this invention. As shown, the platen roller is basically formed with a hard elastic layer 3 arranged round the outer circumference of a solid cylindrical base body 1 which is provided with rotating shafts 2. The hard elastic layer 3 may be formed with a hard rubber, resin or fabric material. Meanwhile, as mentioned in the foregoing, the solid cylindrical base body 1 is arranged to have its outside diameter l within the range of ratio (l/L) from 45 to 75% to the outside diameter L of the finished platen roller which includes the base body 1 and the hard elastic layer 3. This range of ratio is preferably from 55 to 75% and more preferably from 60 to 75%.

The solid cylindrical base body 1 is made of a material selected from a group of such materials that have a high degree of attenuating power with vibration energy consumed by the internal friction of composition, including, for example, metals of relatively large specific gravity such as iron, lead, zinc, etc.; or alloys containing at least one of them such as gray iron, a zinc-aluminum alloy, etc. The solid cylindrical base body 1 may have the rotating shafts formed in one body therewith. With respect to reduction in cost, however, the solid cylindrical base body 1 is preferably arranged in a composite manner to have a base body part 1*a* formed, as shown, separately from rotating shaft parts 2 with the base body part 1*a* made of a material which is different from that of the rotating shaft parts 2.

In the case of such a composite structural arrangement, the rotating shaft parts 2 are preferably made of a stainless steel material which excels in slidability and corrosion resistance while the solid cylindrical base body part 1*a* is preferably made of an iron material which excels in vibration suppressing property and is advantageous in terms of reduction in cost. The rotating shaft parts 2 are fitted into the solid cylindrical base body part 1*a* by pressure fitting, shrink fitting or the like. As mentioned above, the adoption of the composite structural arrangement allows a broader material selecting range as well as reduction in cost.

Figure 2:
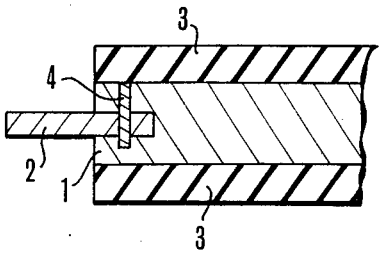

Another example of the platen rollers according to this invention is arranged as follows: FIG. 2 shows it. In this case, the rotating shaft parts 2 are more firmly secured to the base body part 1 by means of pins 4. Each of the pins 4 is inserted into the solid cylindrical base body 1 from outside of the body 1 to pierce through each of the rotating shaft parts 2 perpendicularly to the shaft parts 2. This arrangement effectively prevents the shaft parts 2 from coming off the solid cylindrical base body 1.

Figure 3:
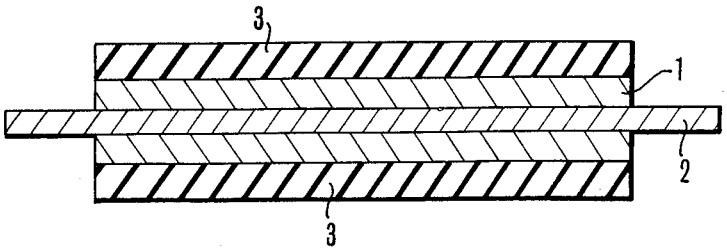

A further example of the platen rollers according to this invention is arranged as shown in FIG. 3. In the case of FIG. 3, the solid cylindrical base body 1 is formed with one rotating shaft 2 allowed to pierce through the base body 1.

Figure 4:
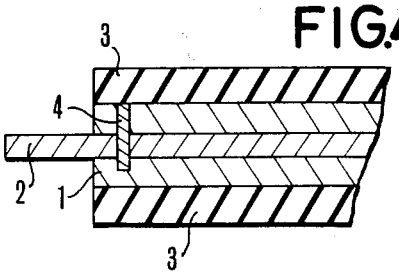

A still further example of the platen rollers according to the invention is arranged as shown in FIG. 4. In this case, with the rotating shaft 2 allowed to pierce through the solid cylindrical base body 1, the shaft 2 is secured to the base body 1 by means of pins 4.

The following description of examples shows further details of the invention:

Embodiment

A solid cylindrical base body 1 was prepared in a manner similar to the arrangement shown in FIG. 1. The rotating shafts were made of stainless steel and the base body part made of iron. A styrene-butadiene rubber material was laminated and applied to the base body 1 to obtain a platen roller which was as shown in FIG. 1.

In this manner, six different platen rollers having different ratios of the diameter l of the solid cylindrical base body to the outside diameter L of the finished platen roller within the range of ratio (l/L) from 45 to 75%, respectively. Each of the platen rollers thus obtained was subjected to a printing test which was carried out by mounting it on a typewriter manufactured by Canon Inc. In testing, a printing sound which was generated during printing was measured by means of a simplified sound meter, Model 2215, manufactured by Brüel & Kjaer which was set 1 m away from the typewriter. All the platen rollers permitted adequate printing with low levels of sound as shown in FIG. 5.

Figure 5:
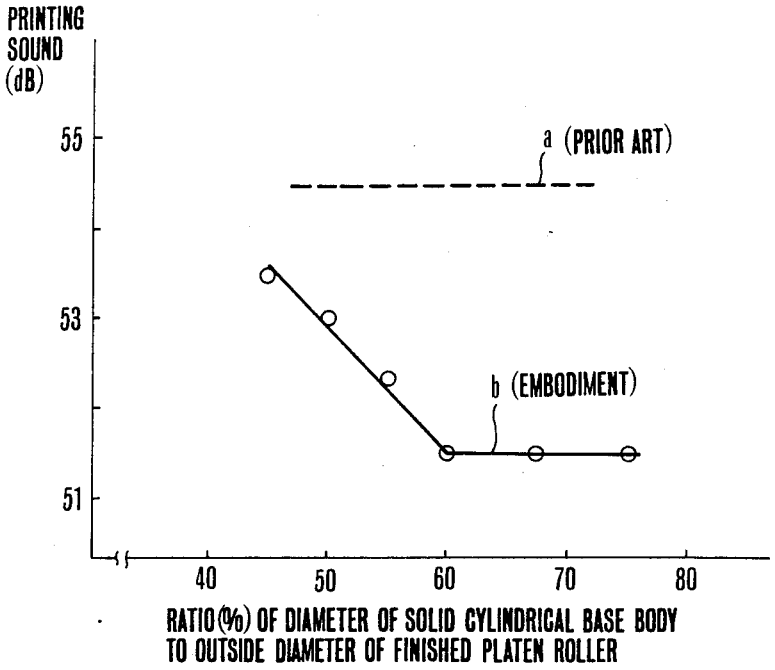
FIG. 5 is a graph showing the printing sound level of the invented platen roller in comparison with that of the conventional platen roller.

Further, FIG. 5 shows the printing sounds measured in dB in relation to the above stated ratio (l/L). The platen rollers arranged according to this invention with the above stated ratio set above 60% showed particularly salient muting effects.

Comparative Example 1:

A platen roller of the conventional type was prepared, as a comparative example, in the same manner as the above stated embodiment with the exception of that the comparative example had a hollow cylindrical base body measuring 3 mm in thickness and that the roller has the above stated ratio l/L set at a different value from the ratio range of this invention. The platen roller was subjected to the same printing test as in the case of the embodiment. Although the printing performance was fairly good, the printing sound of the comparative example was found to be at a much higher level than the level of the embodiment shown in FIG. 5.

Comparative Example 2:

A platen roller was prepared as a second comparative example in the same manner as the above stated embodiment of the invention with the exception of that the second comparative example was arranged to have the above stated l/L ratio at 40%. A printing test was carried out also in the same manner. The printing sound of this platen roller was thus found to be at 54.5 dB which was much higher than that of the embodiment.

Comparative Example 3:

A platen roller was prepared as a third comparative example in the same manner as the above stated embodiment with the exception of that this roller was arranged to have the above stated l/L ratio at 80%. According to the result of the above stated test, while the printing sound generated by this platen roller was at 52 dB thus showing a relatively low level, the roller was too heavy. The roller was thus found to be hardly practicable due to the heavy weight which imposed an excessive load on a motor arranged to drive the roller.

What is claimed is:

1. A platen roller comprising a solid cylindrical base body defining a longitudinal axis and having a first end, a second end and defining an outer surface having a predetermined diameter, said base body providing at least one rotating shaft such that a rotating shaft end protrudes from said first end and a rotating shaft end protrudes from said second end, said rotating shaft ends being aligned generally concentrically with said longitudinal axis;

said platen roller further comprising a hard elastic layer covering said outer surface of the base body having a predetermined diameter, wherein said base body is constructed from a metal selected from the group consisting of lead, iron, zinc and alloys of at least one of such metals, the ratio of the diameter of the base body to the diameter of the elastic layer being from 0.45–0.75:1, said rotating shaft being secured to said base body by means of a pin positioned in said rotating shaft with at least one end at the peripheral surface of said base body, said pin positioned so as not to protrude into the hard elastic layer.

2. A platen roller according to claim 1, wherein the diameter of said solid cylindrical base body is within the range of ratio between 55 and 75% to the outside diameter of said finished platen roller including said solid cylindrical base body and said hard elastic layer.

3. A platen roller according to claim 2, wherein the diameter of said solid cylindrical base body is within the range of ratio between 60 and 75% to the outside diameter of said finished platen roller including said solid cylindrical base body and said hard elastic layer.

4. A platen roller according to claim 1, wherein said hard elastic layer is made of a rubber material.

5. A platen roller according to claim 1, wherein said solid cylindrical base body is made of a metal.

6. A platen roller according to claim 5, wherein said metal is a material selected from the group consisting of iron, lead and zinc, or an alloy material containing at least one of said metals.

7. A platen roller according to claim 1, wherein said rotating shafts are inserted and secured to both ends of said solid cylindrical base body without piercing through said solid cylindrical base body.

8. A platen roller according to claim 1 wherein said rotating shaft is constructed from stainless steel.

9. A platen roller according to claim 1 wherein said base body is iron.

10. A platen roller according to claim 4 wherein said rubber material is a styrene-butadiene copolymer.

11. A platen roller according to claim 9 wherein said rotating shaft is constructed from stainless steel.

* * * * *